United States Patent [19]

Avetoom

[11] Patent Number: 4,912,836

[45] Date of Patent: Apr. 3, 1990

[54] METHOD OF INSTALLING A SPORTS EQUIPMENT GRIP

[76] Inventor: Garnic C. Avetoom, 1633 Highland Dr., Newport Beach, Calif. 92660

[21] Appl. No.: 283,527

[22] PCT Filed: Jan. 29, 1988

[86] PCT No.: PCT/US88/00331

§ 371 Date: Sep. 30, 1988

§ 102(e) Date: Sep. 30, 1988

[87] PCT Pub. No.: WO88/05674

PCT Pub. Date: Aug. 11, 1988

Related U.S. Application Data

[63] Continuation-in-part of Ser. No. 8,758, Jan. 30, 1987, abandoned.

[51] Int. Cl.[4] ..... B23P 11/02

[52] U.S. Cl. ..... 29/450; 273/75; 273/735; 273/81 R

[58] Field of Search ..... 273/735, 75, 81 R, 81 D, 273/81.2, 165; 29/235, 450

[56] References Cited

U.S. PATENT DOCUMENTS

| | | | |
|---|---|---|---|
| 2,038,840 | 4/1936 | Hall | 273/81 R X |
| 2,803,056 | 8/1957 | Brissey, Jr. et al. | 29/450 |
| 3,992,570 | 11/1976 | Beinhaur | 29/450 X |
| 4,016,640 | 4/1977 | Briggs | 29/450 |
| 4,134,198 | 1/1979 | Briggs | 29/450 |
| 4,185,375 | 1/1980 | Brown | 29/450 |
| 4,466,166 | 8/1984 | Hogarth | 273/75 X |
| 4,506,430 | 3/1985 | Guzay, jr. | 29/450 |
| 4,685,189 | 8/1987 | Palmquist et al. | 29/450 |

FOREIGN PATENT DOCUMENTS

| | | | |
|---|---|---|---|
| 19883 | of 1905 | United Kingdom | 273/81 R |

*Primary Examiner*—Edward M. Coven
*Assistant Examiner*—William E. Stoll
*Attorney, Agent, or Firm*—Leonard Tachner

[57] ABSTRACT

A method of installing a sports equipment grip suitable for covering a hardened or worn conventional golf club or tennis racquet grip, the grip comprising a thin conical tube of flexible material such as latex rubber and the steps of the invention comprising: a. providing an elongated, thin walled, conically shaped, tubular grip closed at its broader end and open at its narrower end, the tubular grip being formed of a latex rubber composition and having an inner wall surface and an outer wall surface; b. lubricating the inner wall surface; c. clamping the open end of the tubular grip; d. folding over the clamped end and a portion of the tubular grip; and e. continuing to fold portions of the tubular grip until the closed end inflates; f. pushing the inflated end over at least a portion of the hardened or worn grip; and, g. releasing the trapped air by loosening the grasped open narrower end and sliding the tubular grip over the hardened or worn grip, the tubular grip rolling over itself to invert the inner and outer wall surfaces.

5 Claims, 2 Drawing Sheets

METHOD OF INSTALLING A SPORTS EQUIPMENT GRIP

TECHNICAL FIELD

This application is a continuation-in-part of parent Ser. No. 07008,758, filed 1-30-87, now abandoned.

The present invention relates generally to grips for sports equipment such as golf clubs, tennis racquets and the like and more specifically, to overgrips or skins which are disposable and readily applied over the original grips of such equipment.

BACKGROUND ART

Sports equipments grips in current use are typically made of leather or molded rubber with various additives such as cork. Unfortunately, these grips wear and harden with use and thus lose their tackiness. Consequently, the entire grip has to be replaced, which involves cutting, scraping, the use of solvents, adhesives and clamps. This process is wasteful, time consuming, inconvenient and expensive. It also exposes a person unnecessarily to petrochemical solvents, fumes and adhesives.

Previous attempts to recover a worn and hardened golf grip have involved the use of various materials in the form of tape but these attempts have presented various problems. For example, they are too troublesome and time consuming, use too thick a material, result in an oversized grip, require using adhesive to keep it in place and prevent peeling and finally, require taping down the tail end of the taped material.

To date, all attempts at recovering have been abandoned for all practical purposes and the only remedy has been to replace the grip. This usually means leaving the racket or clubs at an equipment facility and returning to collect them. It is neither cheap nor convenient and it is a process which has to be repeated at regular intervals.

Thus there has been a long-felt need for a simple, fast, economical and efficient way of regripping a tennis racket, golf club or other sports equipment of the type having a grip. This need has so far remained unsatisfied.

SUMMARY OF THE INVENTION

The present invention overcomes the aforementioned disadvantages of the prior art by providing a grip specifically designed to be manufactured by low cost techniques such as latex dipping. It is reliable in use and its installation does not depend on the use of hazardous petrochemical substances. It improves on the original grip by producing a far greater coefficient of friction and it eliminates entirely the need to remove the old grip. It is formed as a conical, hollow tube preferably of thin latex rubber or other flexible material, it is easily slipped over an existing grip and readily conforms to the shape thereof.

The present invention is unique in its concept and design in that it takes full advantage of the properties of the material of manufacture, preferrably latex rubber. The memory character of the material permits stretching over any size grip and conforming to the shape of that grip on contraction. The contraction of the material is of such magnitude that the use of adhesives is unnecessary. One end being closed permits trapping of air, and compressing that air to balloon the material and permit easy placement of the grip over the club and simply inverting the grip inside out, down the shaft of the club being regripped. The ability to manufacture in very thin sheath form permits the use of either surface of the grip by turning the grip inside out. The design also allows easy and frequent removal and reapplication of the grip in different positions to extend appreciably the useful life of the grip. The closed end also prevents entry of water down the shaft of the club and prevents corrosion.

OBJECTS OF THE INVENTION

It is therefore a principal object of the present invention to provide a sports equipment grip which eliminates the time consuming, inconvenient, wasteful and expensive necessity of removing the original grip.

It is an additional object of the present invention to provide a sports equipment grip which is simple and expedient to install without the use of tools, solvents or adhesives.

It is still an additional object of the present invention to provide a sports equipment grip which readily conforms to the shape of the underlying worn grip.

It is still an additional object of the present invention to provide a sports equipment grip which provides a cushioning effect on the hands of the user.

It is still an additional object of the present invention to provide a sports equipment grip which provides a high coefficient of friction or tackiness.

It is still an additional object of the present invention to provide a sports equipment grip which is reversible and disposable.

It is still an additional object of the present invention to provide a sports equipment grip which is of a configuration particularly suitable for low cost manufacture.

BRIEF DESCRIPTION OF THE DRAWINGS

The aforementioned objects and advantages, as well as additional objects and advantages thereof, will be more fully understood hereinafter as a result of a detailed description of a preferred embodiment of the invention when taken in conjunction with the following drawings in which.

DETAILED DESCRIPTION OF A PREFERRED EMBODIMENT

Figure 1:
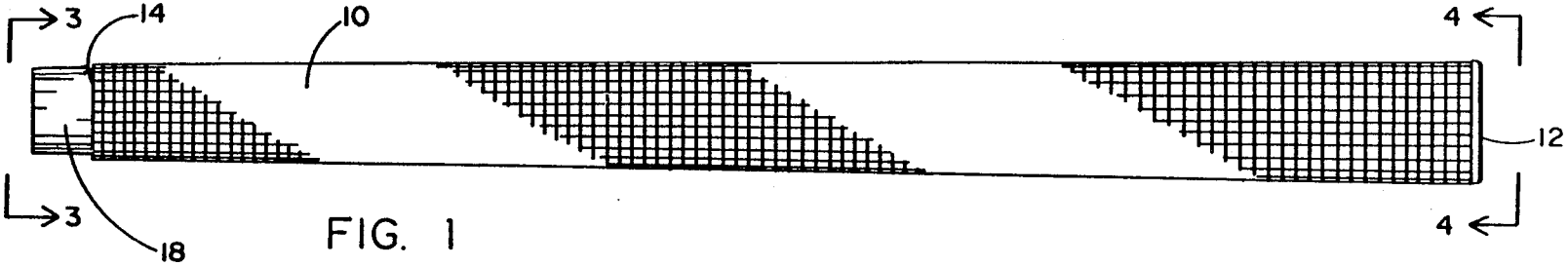
FIG. 1 is an elevational view of the present invention.
Figure 2:
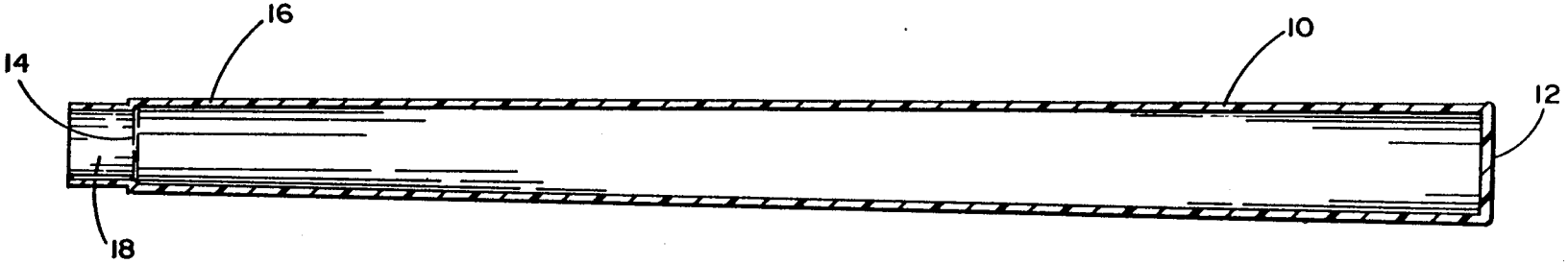
FIG. 2 is a full length cross-sectional view of the invention.
Figure 4:
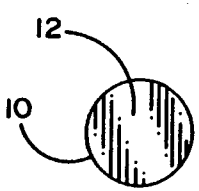
FIG. 4 is an axially viewed second end of the invention.
Figure 3:
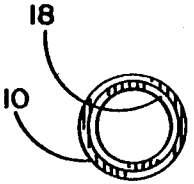
FIG. 3 is an axially viewed first end view of the invention.
Figure 5:
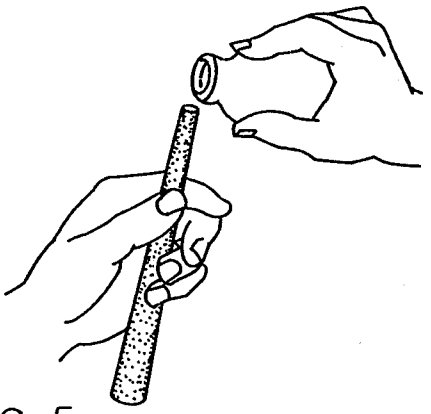
FIGS. 5–10 illustrate the sequence of steps for performing the installation method of the invention.
Figure 6:
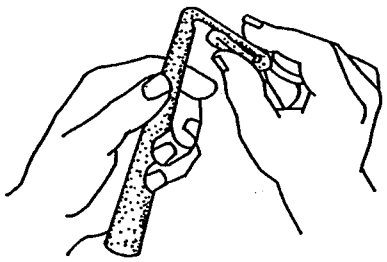
Figure 7:
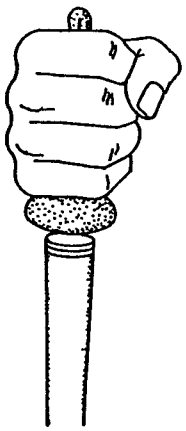
Figure 8:
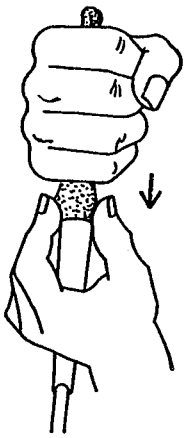
Figure 9:
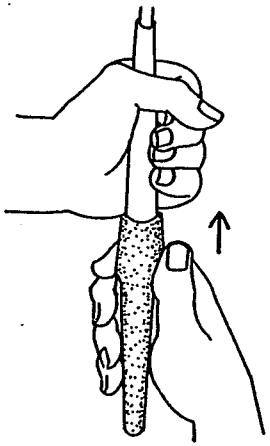
Figure 10:
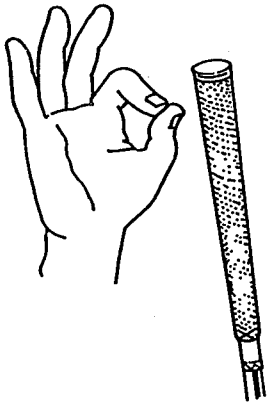

Referring now to FIGS. 1–4, it will be seen that the present invention comprises a tubular member 10 which is of an elongated, thin wall, conically tapered configuration. Tubular member 10 is closed at its broader end 12 and open at its narrower end 14. The configuration shown in FIGS. 1–4 is especially suited for use on golf clubs, but the invention finds advantageous use on virtually any type of sports equipment which employs an elongated grip such as tennis rackets, racquetball rackets, baseball bats and the like. The golf club configuration employs a tubular member which is about 11 inches long, has an outer diameter of about 0.925 inches at end 12 and an outer diameter of about 0.5 inches at end 14. The wall 16 has a thickness which varies along the length of member 10. Specifically, the wall thickness is about 0.04 inches at end 12 and about 0.03 inches at end 14. The wall thickness at about the center of member 10 is about 0.035 inches. The narrower end 14 of member 10 is integrally connected to a ring-shaped portion 18 which is about 0.5 inches long and has an outer diameter which is about 0.08 inches less than the outer diameter of end 14 and about the same wall thickness. The surface of member 10 is preferably textured to increase frictional engagement therewith.

Tubular member 10 is preferably made of latex rubber or other materials having at least the same elasticity and coefficient of friction. Installation of the inventive gripping article may be easily accomplished by carrying out the following procedure:

(1) A teaspoon of liquid soap or other water soluble viscous liquid is poured into the gripping article to serve as a lubricant;

(2) The open end 14 is then clamped and the tubular member repeatedly folded like a tube of toothpaste, trapping air at the closed end 12 until that end balloons out slightly;

(3) The ballooned end is then placed over the club or other sports equipment handle being regripped and pushed down gently until at least a portion of the ballooned end is started on the club or handle;

(4) With the closed end over the club or handle, the trapped air is released;

(5) The tubular member is then slid down over the club or handle while inverting the member so that the inner surface before installation becomes the outer surface after installation;

(6) The liquid soap or other lubricant may then be washed off.

Removal of the gripping article may be effected by simply rolling the tubular member from the open end toward the end of the club or handle. The invention is preferably fabricated by dipping a tubular mold in hot liquid latex and curing the latex to form a sleeve in the range of 20 to 40 gauge.

It will now be understood that what has been disclosed herein comprises a novel gripping article for regripping sports equipment such as golf clubs, tennis rackets and the like. The article is, in one exemplary embodiment, configured as an elongated tubular member preferably made of latex rubber and having a conical shape with a decreasing wall thickness from a broad closed end to a narrow open end. The invention may be readily installed without tools over existing grips and secured thereto without adhesive thereby obviating the prior art process of removing and replacing worn or damaged grips. Installation is facilitated by a wall thickness and elasticity which permits the gripping article to be folded over a plurality of folds like a tube of toothpaste and reversed inside-out.

Those having skill in the art to which the present invention pertains will, as a result of applicant's teaching herein, now perceive various modifications and additions. By way of example, other geometries and other materials will now occur to those having the benefit of the present disclosure. However, all such modifications and additions are deemed to be within the scope of the invention which is to be limited only by the claims appended hereto.

I claim:

1. A method of installing a sports equipment grip over a hardened or worn grip, comprising:

a. providing an elongated, thin walled, conically shaped, tubular grip closed at its broader end and open at its narrower end, said tubular grip being formed of a latex rubber composition and having an inner wall surface and an outer wall surface;

b. lubricating said inner wall surface;

c. clamping said open end of said tubular grip;

d. folding over said clamped end and a portion of said tubular grip; and, e. continuing to fold portions of said tubular grip until said closed end inflates;

f. pushing inflated end over at least a portion of said hardened or worn grip; and, g. releasing said trapped air by loosening the grasped open narrower end and sliding said tubular grip over said hardened or worn grip, said tubular grip rolling over itself to invert said inner and outer wall surfaces.

2. The method as recited in claim 1 where the step of lubricating said inner wall surface includes the step of:

pouring a predetermined quantity of water or soluble lubricant into said tubular grip.

3. The method as recited in claim 2 where the step of pouring a predetermined quantity of water soluble lubricant includes the step of:

pouring one teaspoon of said water soluble lubricant into said tubular grip.

4. The method as recited in claim 3 where the step of pouring said teaspoon of said water soluble lubricant includes the step of:

pouring one teaspoon of a liquid soap into said tubular grip.

5. The method as recited in claim 1 where the step of releasing said trapped air and sliding said tubular grip over said lubricant or worn grip is followed by the step of:

washing off said lubricant.

* * * * *